US006689969B1

(12) United States Patent
Abroy et al.

(10) Patent No.: US 6,689,969 B1
(45) Date of Patent: Feb. 10, 2004

(54) SWITCH ENCLOSURE AND OPERATING HANDLE APPARATUS

(75) Inventors: Hamid S. Abroy, Lexington, KY (US); Henry B. Joines, Lexington, KY (US)

(73) Assignee: Square D Company, Palatine, IL (US)

( * ) Notice: Subject to any disclaimer, the term of this patent is extended or adjusted under 35 U.S.C. 154(b) by 0 days.

(21) Appl. No.: 10/331,922

(22) Filed: Dec. 31, 2002

(51) Int. Cl.[7] ..... H01H 9/20
(52) U.S. Cl. ..... 200/50.32; 200/293
(58) Field of Search ..... 200/1 R, 17 R, 200/18, 50.01, 50.32, 50.33, 50.35, 293, 1 V

(56) References Cited

U.S. PATENT DOCUMENTS 4,760,278 A * 7/1988 Thomson ..... 307/64
5,397,868 A * 3/1995 Smith et al. ..... 200/18
5,777,283 A * 7/1998 Greer ..... 200/18
6,320,143 B1 * 11/2001 Greer ..... 200/50.33

* cited by examiner

*Primary Examiner*—Michael Friedhofer
(74) *Attorney, Agent, or Firm*—David R. Stacey; Larry T. Shrout; Larry I. Golden

(57) ABSTRACT

An enclosure and operating handle apparatus for a double throw switch is disclosed. An operating handle support defines two distinct switch compartments within the enclosure and supports an operating handle apparatus configured for selectively operating only one of two switches inside the enclosure at a time.

19 Claims, 11 Drawing Sheets

SWITCH ENCLOSURE AND OPERATING HANDLE APPARATUS

CROSS-REFERNCE TO RELATED PATENTS

Not applicable

STATEMENT REGARDING FEDERALLY SPONSORED RESEARCH OR DEVELOPMENT

Not applicable

FIELD OF THE INVENTION

The present invention relates to electrical switches, and particularly to a mechanism and enclosure for a double throw switch.

BRIEF DESCRIPTION OF THE DRAWINGS

The features of the invention will become more clearly understood from the following detailed description of the invention read together with the drawings in which.

Figure 1:
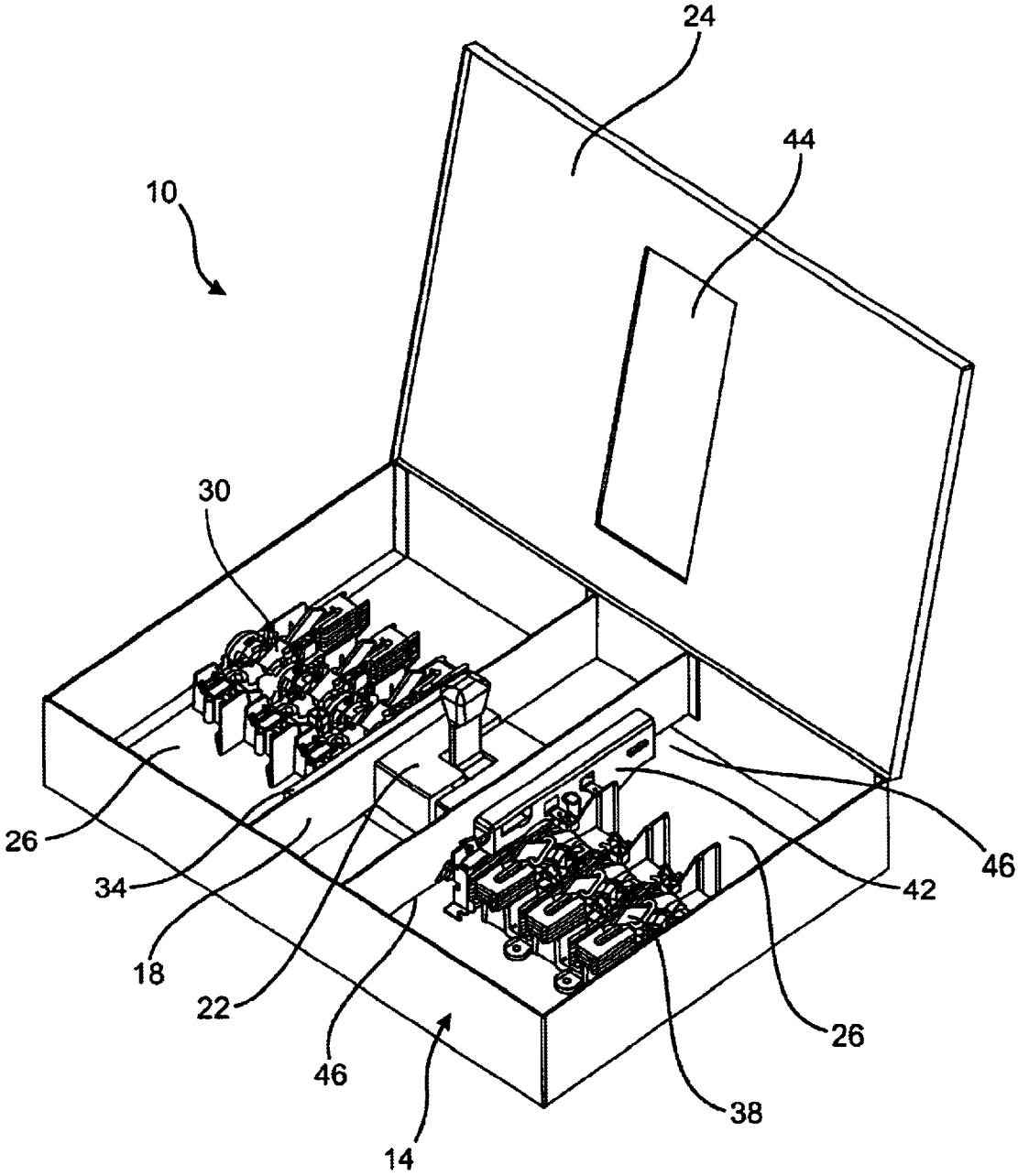
FIG. 1 illustrates a double throw switch incorporating an enclosure manufactured in accordance with the present invention.

Before one embodiment of the invention is explained in detail, it is to be understood that the invention is not limited in its application to the details of construction described herein or as illustrated in the drawings. The invention is capable of other embodiments and of being practiced or being carried out in various other ways. Further, it is to be understood that the phraseology and terminology used herein is for the purpose of description and should not be regarded as limiting.

DETAILED DESCRIPTION OF THE DRAWINGS

FIG. 1 illustrates a double throw switch, generally indicated by reference numeral 10, which incorporates an enclosure 14, an operating handle apparatus support 18, an operating handle apparatus 22 and a cover 24, manufactured in accordance with the present invention. The operating handle apparatus support 18 is positioned in the enclosure 14 such that two distinct switch compartments 26 are defined inside the enclosure 14. A first switch 30 and first switch operating mechanism 34 are enclosed in one of the two compartments 26 and a second switch 38 and second switch operating mechanism 42 are enclosed in the other of the two compartments 26. Any switch operating mechanism that can be operably connected to the operating handle apparatus 22 can be used. The cover 24 defines an opening 44, which provides access to the operating handle apparatus 22. A conductor passage 46 is provided for the passage of electrical conductors (not shown) between the two switch compartments 26.

Figure 2:
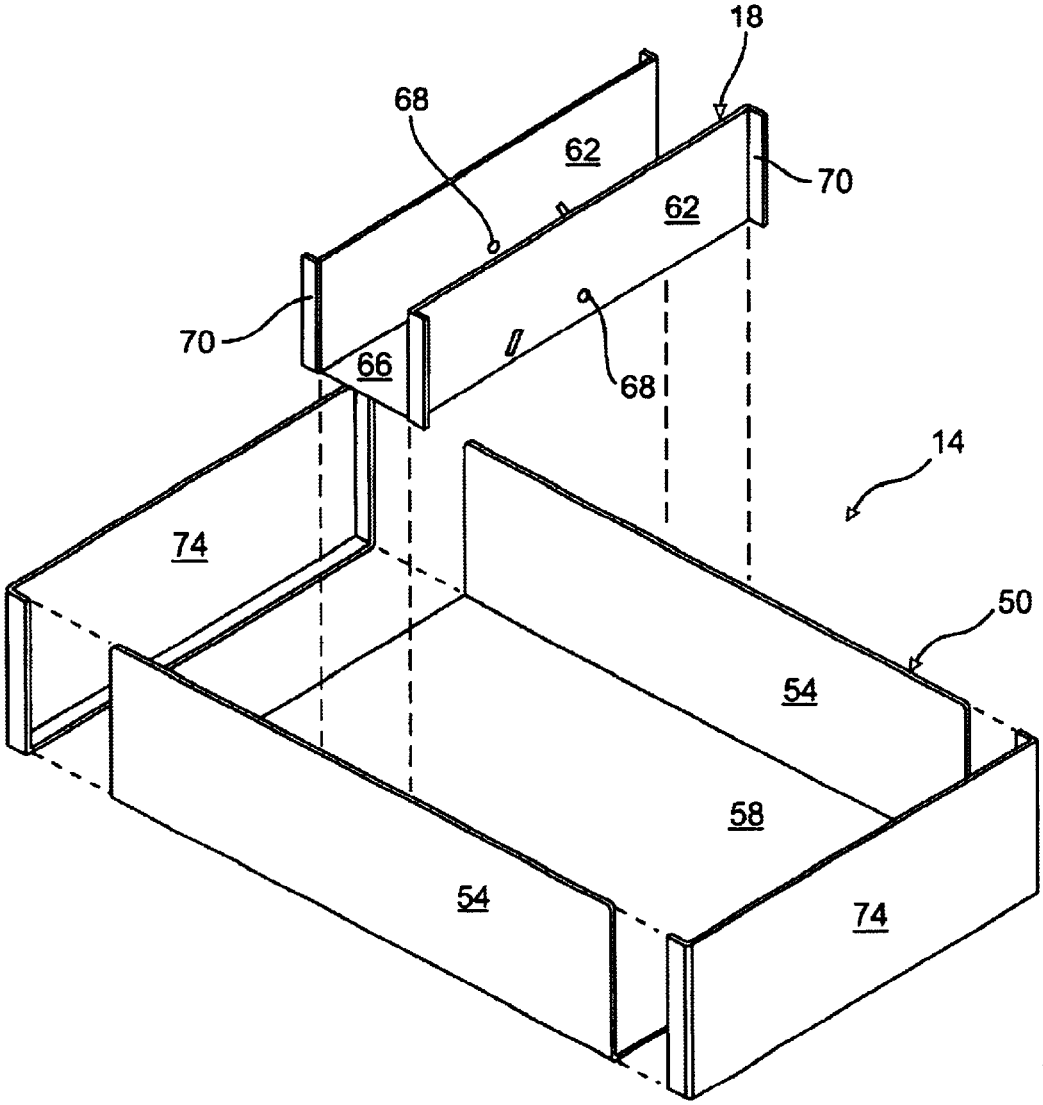
FIG. 2 is an exploded view of the switch enclosure of FIG. 1.

FIG. 2 illustrates, in exploded view, one embodiment of the enclosure 14 and operating handle support 18 of FIG. 1. The enclosure 14 includes a bottom 50 defining two generally parallel sides 54 and a back 58, intermediate the two sides 54, and two open ends. The operating handle apparatus support 18 is a generally U-shaped trough having generally parallel sides 62 and an intermediate bottom 66. Each of the generally parallel sides 62 defines an aperture 68, positioned directly opposite one another, for receiving an extending end of an operating shaft of each of the first and second switch operating mechanisms, 34 and 42, respectively. The operating handle apparatus support 18 is dimensioned to fit snugly between the two parallel sides 54 of the enclosure 14. Flanges 70 are provided at each end of the operating handle apparatus support 18 for attachment to the parallel sides 54 of the enclosure 14. The attachment can be accomplished by any suitable means, such as for welding, riveting or screwing to the parallel sides 54. End closures 74 are provided for closing the open ends of the enclosure 14. In this embodiment, the conductor passage 46 (FIG. 1) is defined between the back 58 of the enclosure bottom 50 and the bottom 66 of the operating handle apparatus support 18.

Figure 3:
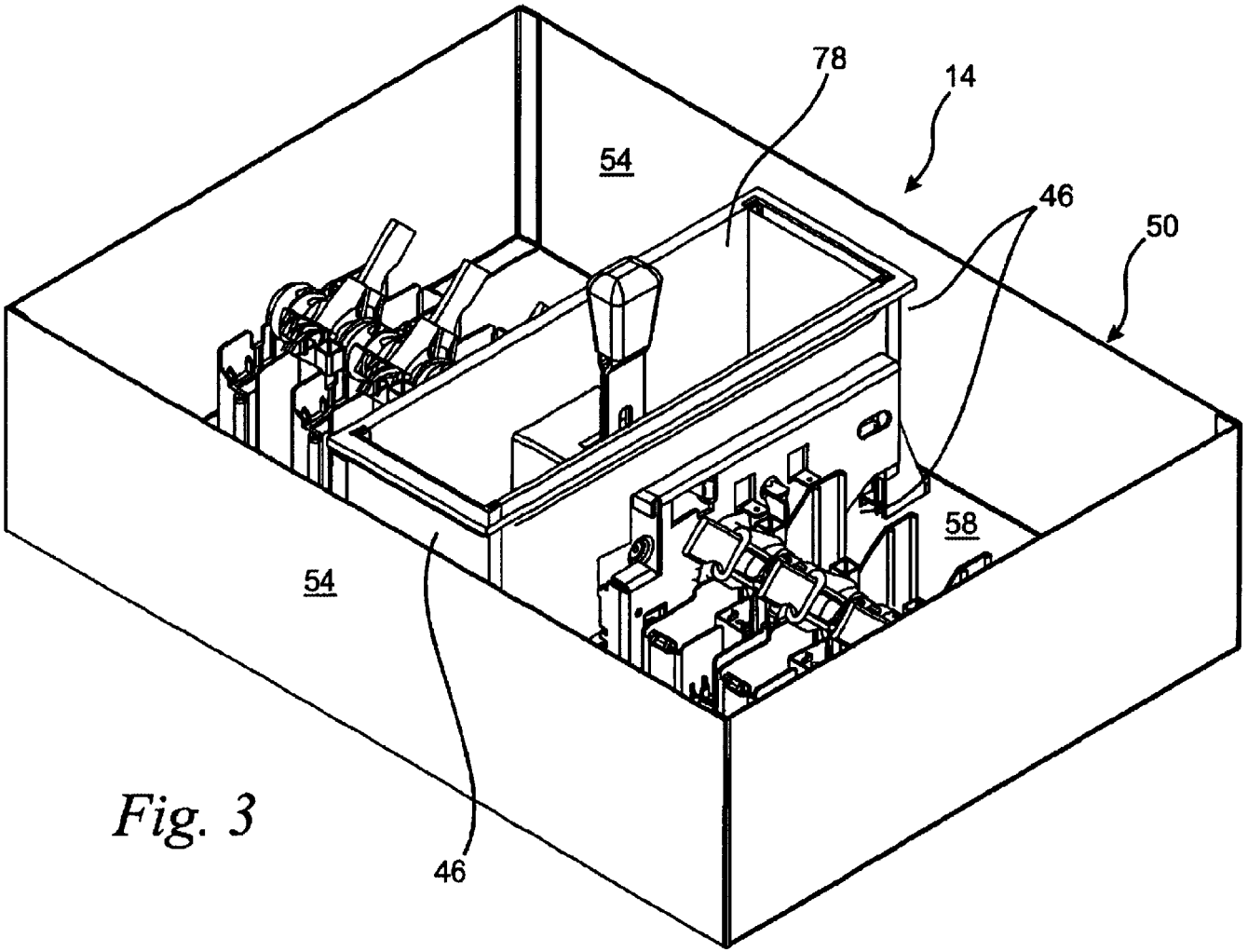
FIG. 3 illustrates a second embodiment of the switch enclosure of FIG. 1.

FIG. 3 illustrates the enclosure 14 with a second embodiment of the operating handle apparatus support 78. In this embodiment, the operating handle support 78 is of modularized construction and is attached to the back 58 of the enclosure bottom 50 in a manner that defines a conductor passage 46 between the back 58 of the enclosure bottom 50 and the operating handle apparatus support 78. The operating handle apparatus support 78 can be spaced apart from one or both of the generally parallel sides 54 such that one or two conductor passages 46 are defined between the operating handle apparatus support 78 and the generally parallel sides 54.

Figure 4:
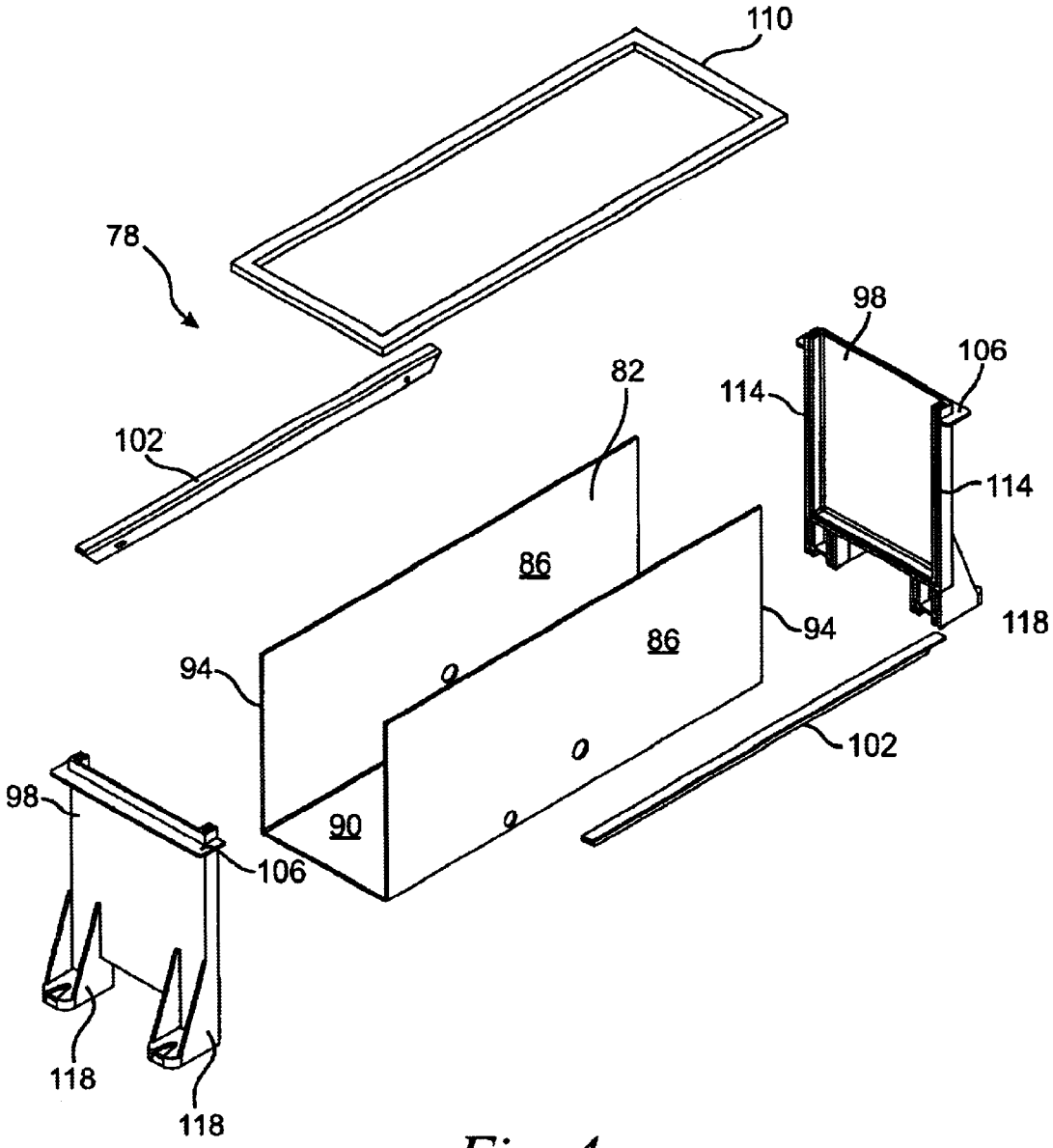
FIG. 4 is an exploded view of the operating handle apparatus support of FIG. 3.

FIG. 4 is an exploded view of the modularized operating handle apparatus support 78. In this modularized configuration, the operating handle apparatus support 78 includes a generally U-shaped trough 82 which defines two generally parallel sides 86, a bottom 90 intermediate the sides 86, and two ends 94, two end closures 98, and two side flanges 102. The end closures 98 also define an integral flange 106, which cooperates with side flanges 102 to provide a continuous flange around the operating handle support 78. A gasket 110 can be applied to the flanges 102/106 for sealing the operating handle apparatus support 78 with a cover (not shown). The end closures 98 have grooves 114 configured to receive the ends 94 of the trough 82. The end closures 98 also have mounting feet 118, which space the operating handle apparatus support 78 away from the back 58 of the enclosure bottom 50 and provide the means for attachment to the back 58.

Figure 5:
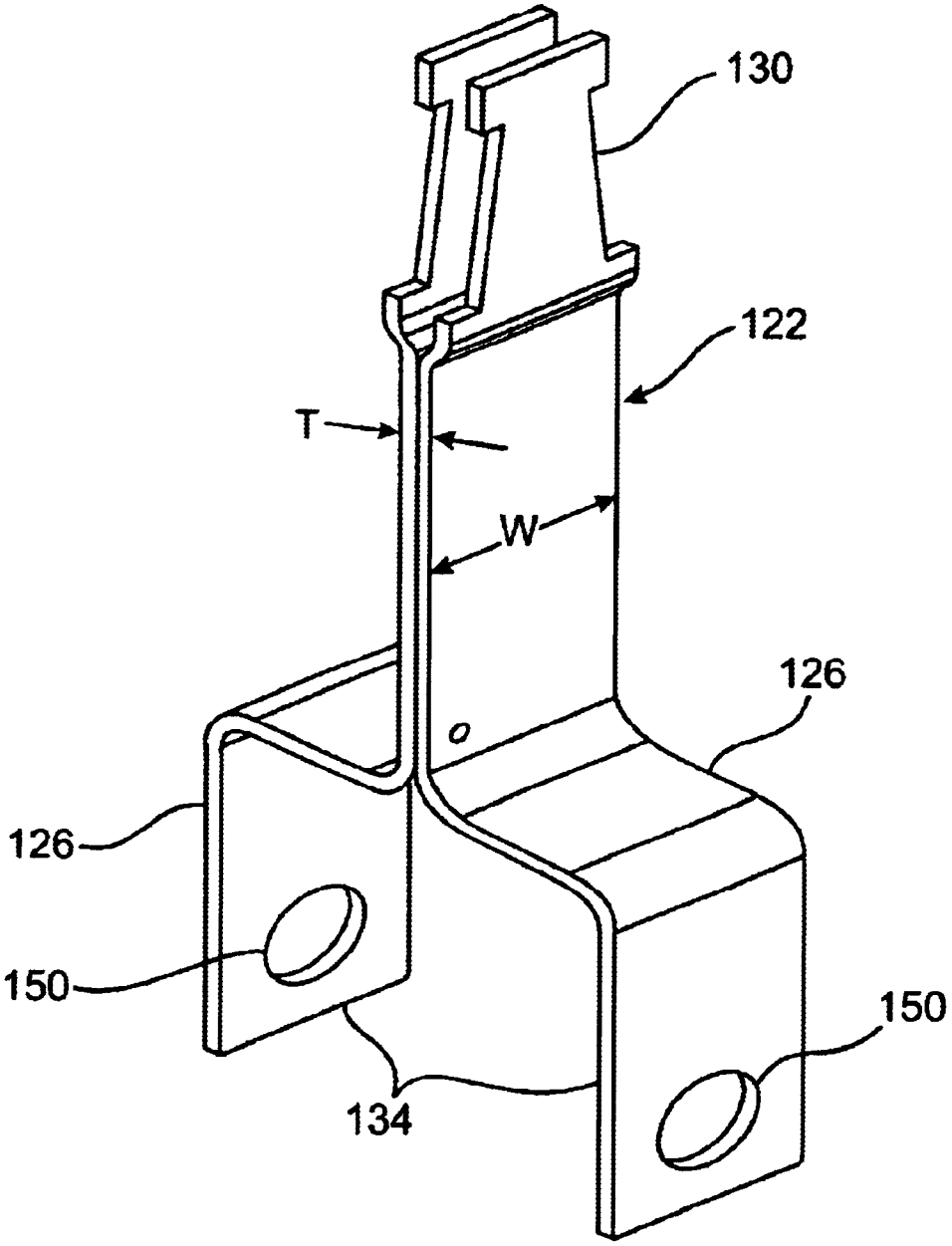
FIG. 5 illustrates an operating handle manufactured in accordance with the present invention.

FIG. 5 illustrates an operating handle 122 constructed in accordance with the present invention. The operating handle 122 is made from two generally identical handle halves 126, which, when assembled in opposed relationship, form an operator end 130 and a switch end 134. The operator end 130 is configured for receiving an operator interface knob 138 (shown in FIGS. 1 and 3) and the switch end 134, where the two handle halves 126 are spaced apart, is configured for selectively interfacing with one of two handle engaging yokes 142 (shown in FIG. 6). Each of the handle halves 126 defines a pivot aperture 146 at the switch end 134.

Figure 6:
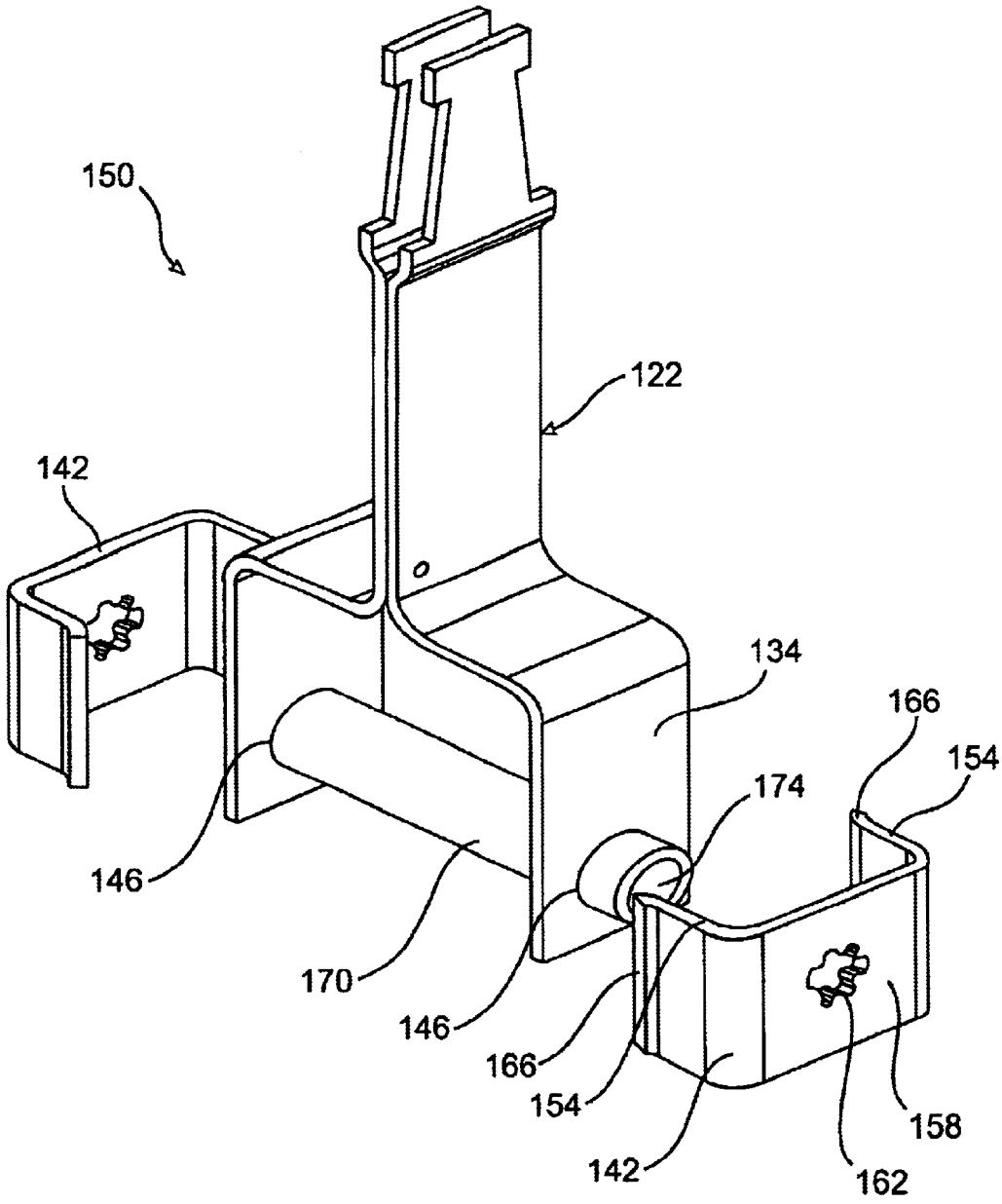
FIG. 6 illustrates an operating handle apparatus manufactured in accordance with the present invention.

FIG. 6 is an exploded view of an operating handle apparatus, generally indicated by reference numeral 150, in accordance with the present invention. The handle engaging yokes 142 are generally U-shaped in cross-section such that two legs 154 and an intermediate web 158 are defined. The web 158 further defines a means for operatively engaging a shaft of the switch operating mechanism (not shown). In this embodiment the engaging means is an aperture 162 having a gear like configuration; however, the actual means or shape of the aperture 162 can be any configuration that will permit the transfer of rotational movement from the handle engaging yoke 142 to the switch operating mechanism. The space between the two legs 154 is dimensioned for snugly receiving the switch end 134 of the operating handle 122, and each leg 154 has an outwardly turned end 166 for easier insertion of the switch end 134 of the operating handle 122. A pivot shaft 170 is snugly but slidably received in the pivot apertures 146 of the switch end 134 such that the operating handle 122 can pivot about the pivot shaft 170. The length of the pivot shaft 170 is dimensioned such that when a handle engaging yoke 142 is placed at each end the pivot shaft 170, the pivot shaft 170 and the two handle engaging yokes 142 will fit snugly between the two generally parallel sides 62 of the operating handle apparatus support 18. An aperture 174 is defined in each end of the pivot shaft 170 for receiving the extending end of the operating shaft (not shown) of each of the first and second switch operating mechanisms, 34 and 42, respectively. The operating shaft extensions hold the pivot shaft 170 in proper position between the two parallel sides 62 of the operating handle apparatus support 18. This relationship is the same for the generally U-shaped trough 82 of the modularized operating handle apparatus support 78.

Figure 7:
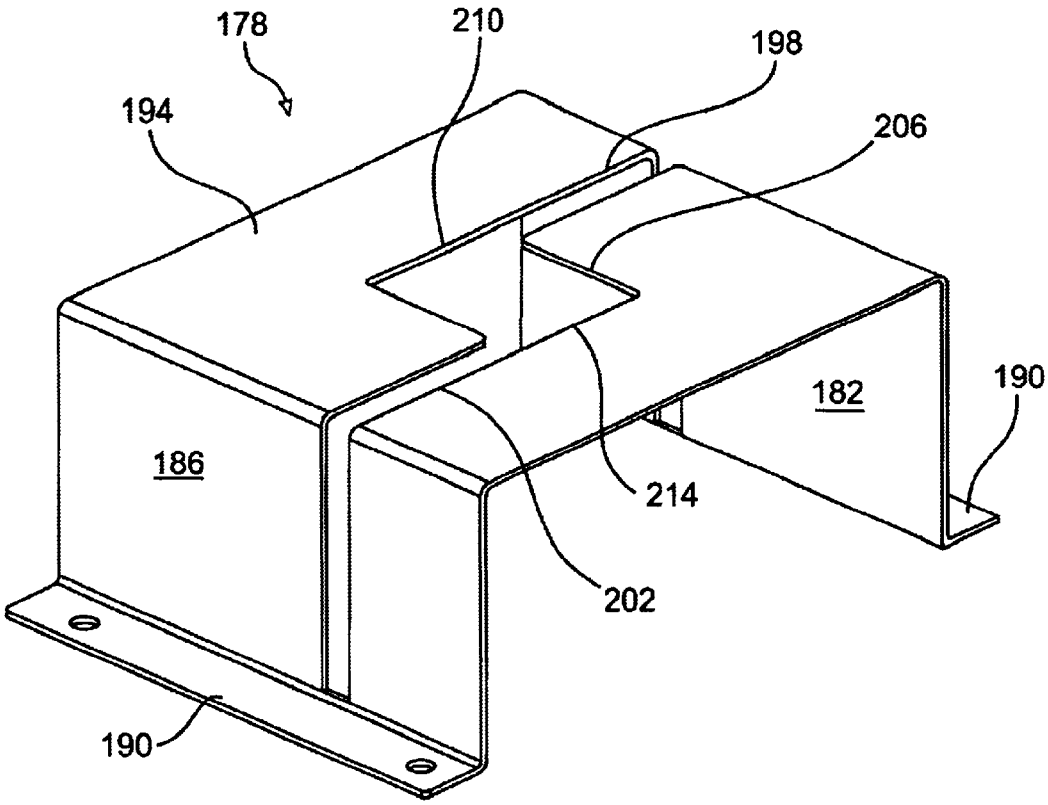
FIG. 7 illustrates an operating handle apparatus enclosure manufactured in accordance with the present invention.

FIG. 7 illustrates an operating handle apparatus enclosure generally indicated by reference numeral 178 and constructed in accordance with the present invention. The operating handle apparatus enclosure 178 has a first side 182, a second side 186, each having a distal mounting flange 190 and a top 194, intermediate the sides 182 and 186. The operating handle apparatus enclosure 178 defines a first switch operating slot 198, a second switch operating slot 202 and a neutral slot 206, which extends generally along the center line of the top 194. The neutral slot 206 has a first end 210 intersecting the first switch operating slot 198 and a second end 214 intersecting the second switch operating slot 206. The first switch operating slot 202 extends from the first end 210 neutral slot 206 down the first side 182 to the flange 190 and the second switch operating slot 202 extends from the second end 214 of the neutral slot 206 down the second side 186 to the flange 190. The first and second switch operating slots, 198 and 202, are dimensioned to receive the thickness T (FIG. 5) of the operating handle 122 and the neutral slot 206 is dimensioned to receive the width W of the operating handle 122 (FIG. 5). The operation of the operating handle 122 in the neutral slot 206 and first and second switch operating slots, 198 and 202, respectively, will be explained later.

Figure 8:
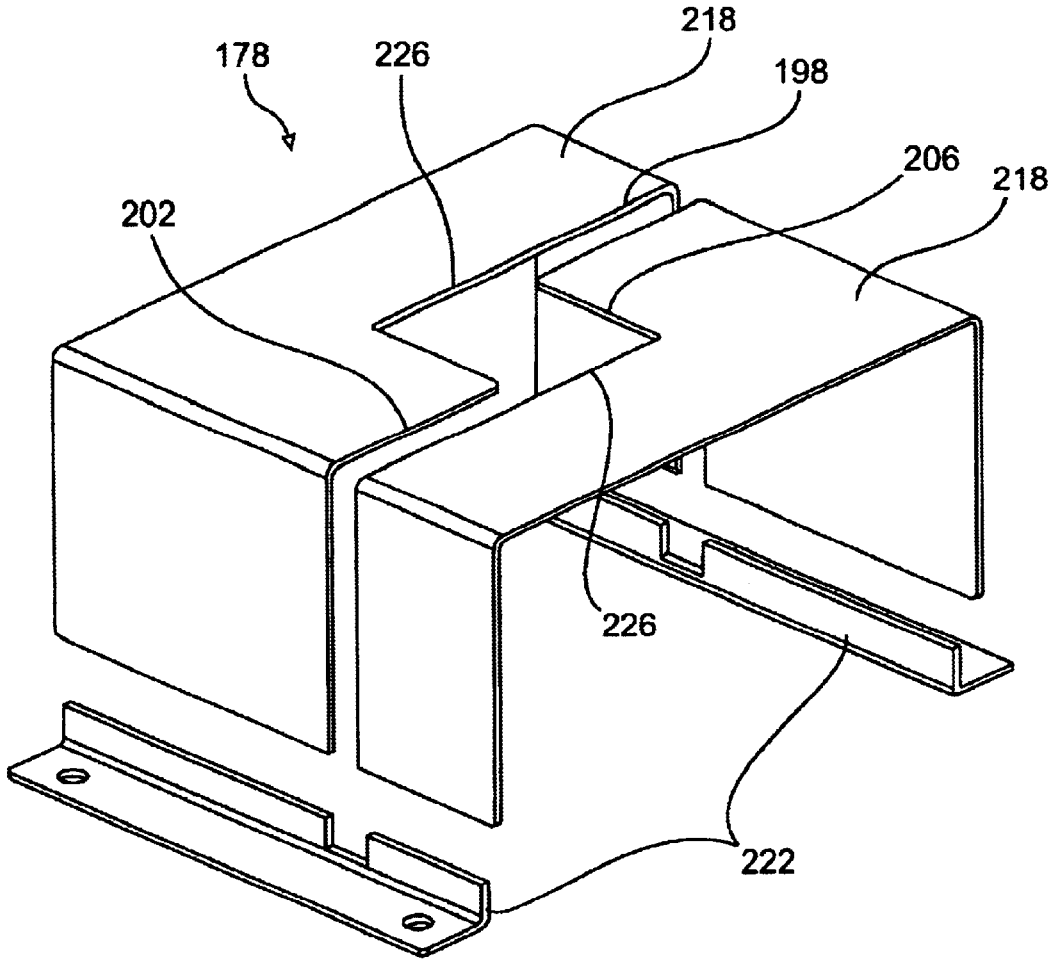
FIG. 8 is an exploded view of a second embodiment of the operating handle apparatus enclosure.

FIG. 8 illustrates an exploded view of an embodiment of the operating handle apparatus enclosure 178 made from two generally identical enclosure halves 218 and two flanges 222. In this embodiment, each enclosure half 218 has one edge 226, which defines one side of each of the first and second switch operating slots, 198 and 202, respectively, and the neutral slot 206. The two enclosure halves 218 are positioned such that the edges 226 are in opposed relationship, thus forming the slots 198, 202 and 206, between the opposed edges 226. The two edges 226 are spaced apart such that the first and second switch operating slots, 198 and 202, respectively, are dimensioned to receive the thickness T (FIG. 5) of the operating handle 122 and the neutral slot 206 is dimensioned to receive the width W of the operating handle 122 (FIG. 5). The two enclosure halves 218 are then attached to the flanges 222.

Figure 9A:
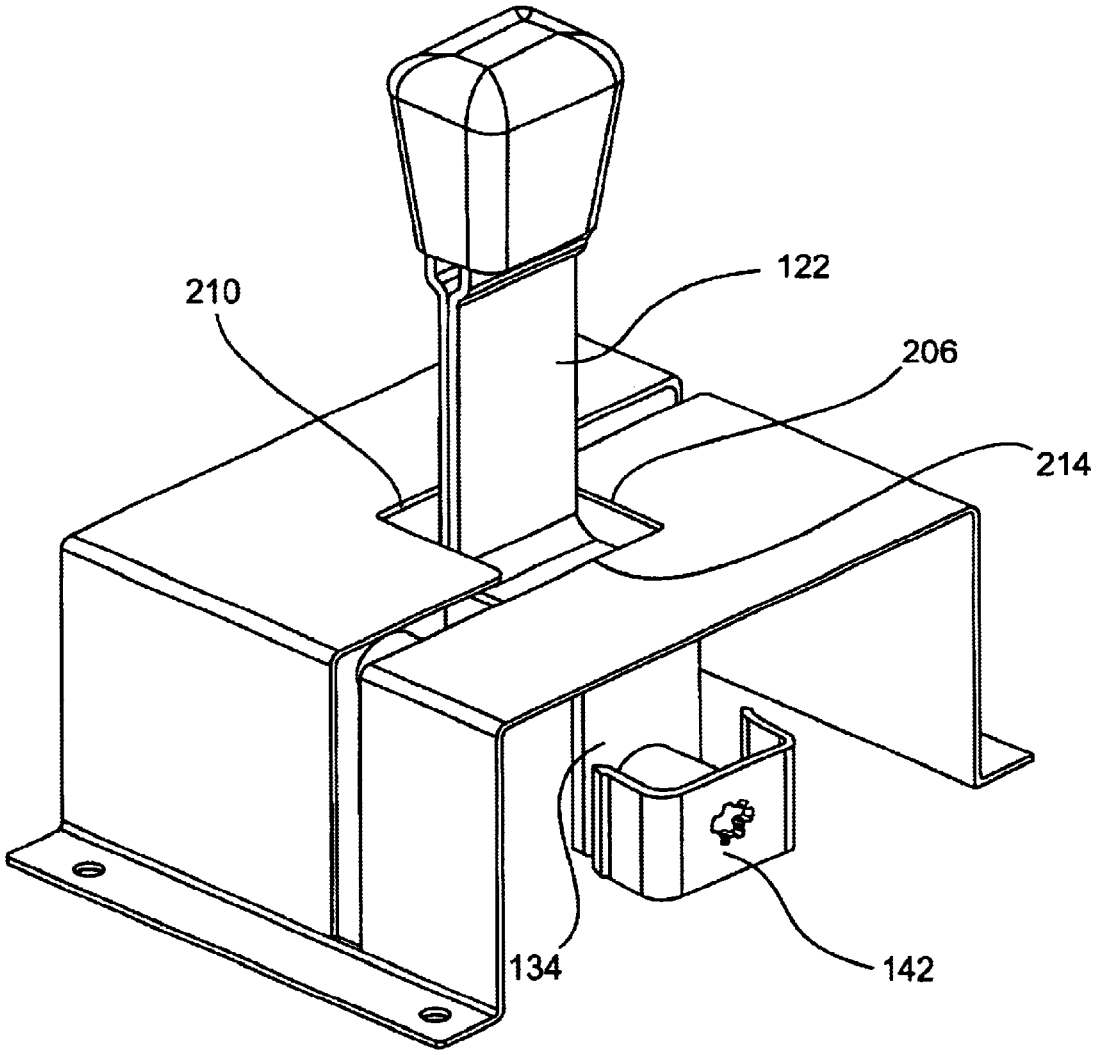
FIG. 9A illustrates the operating mechanism in a neutral position wherein neither of the two switches can be operated and both are in an OFF state.
Figure 9B:
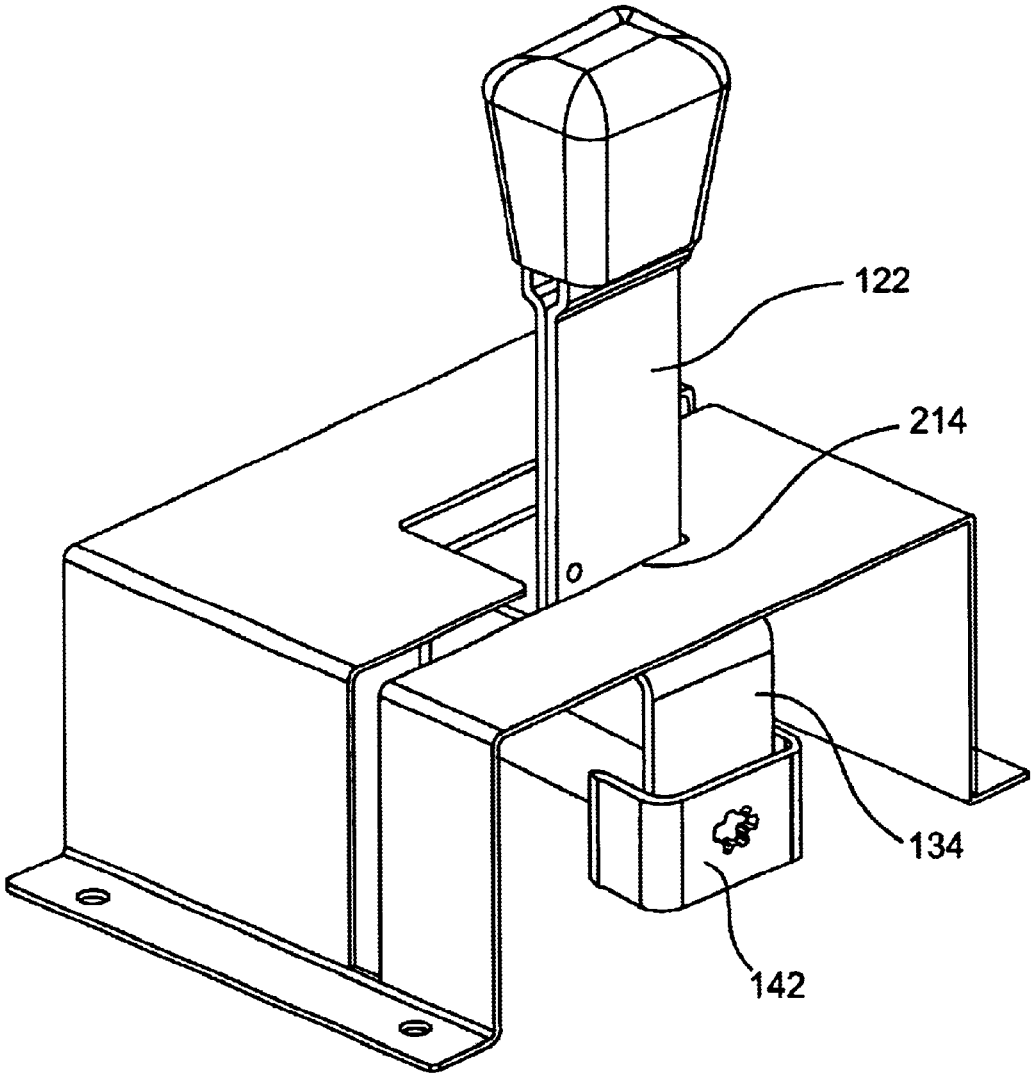
FIG. 9B illustrates the operating mechanism in a position wherein one of the two switches can be operated.
Figure 9C:
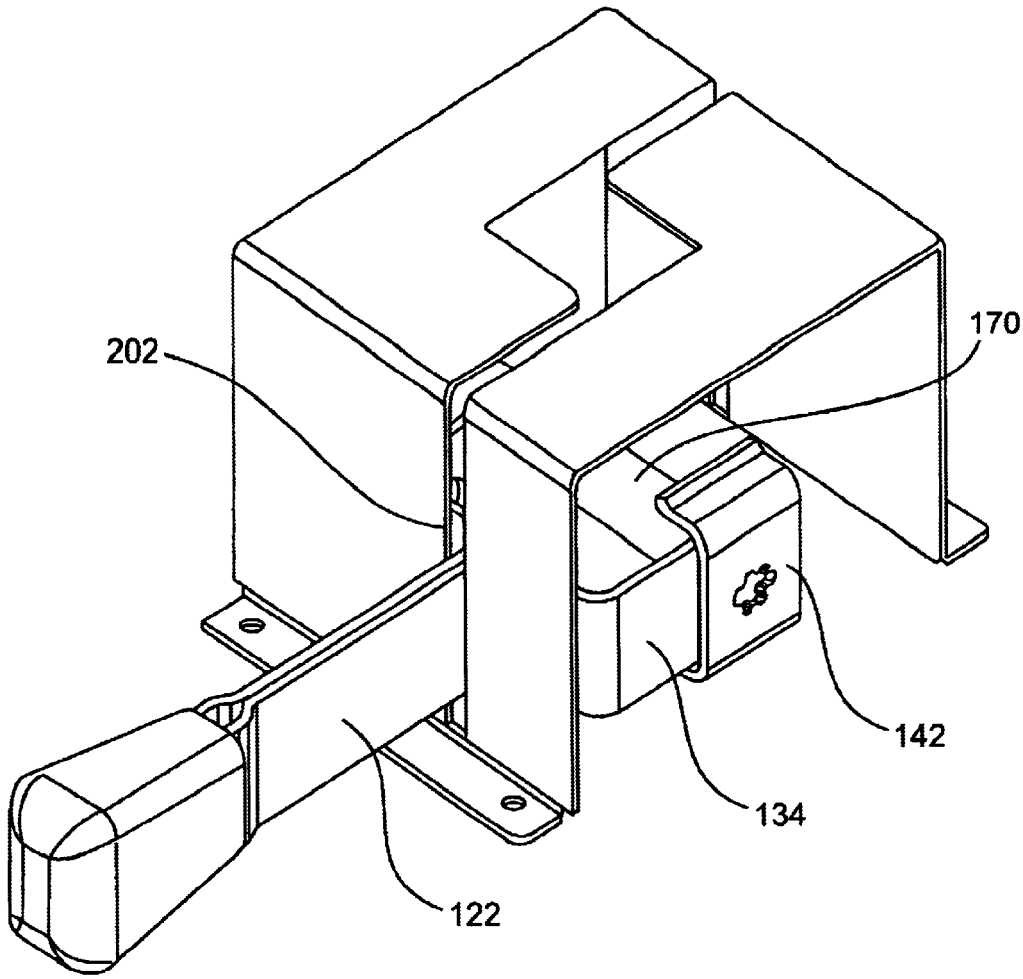
FIG. 9C illustrates the operating mechanism in a position placing one of the two switches in an ON state.

FIGS. 9A–9C illustrate the operational relationship of the operating handle 122 and the first and second switch operating slots, 198 and 202, respectively, and the neutral slot 206. As shown in FIG. 9A, when the operating handle 122 is in the neutral slot 206, and located at some position other than either of the first or second ends, 210 or 214, respectively, neither of the spaced apart switch ends 134 engage either of the handle engaging yokes 142. In this position, both of the switches of the double throw switch 10 are OFF or OPEN as shown in FIGS. 1 and 3. While in the neutral slot 206, the operating handle 122 can be selectively moved to either of the first or second ends, 210 or 214 respectively, of the neutral slot 206, such that one of the spaced apart switch ends 134 engages one of the handle engaging yokes 142, thereby permitting the operation of one of the first or second switch operating mechanisms 34 or 42. FIG. 9B illustrates a condition wherein the operating handle 122 is at the second end 214 of the neutral slot 206, the switch end 134 has engaged the handle operating yoke 142 attached to the second switch operating mechanism 42, and both switches 30 and 38 remain in the OFF or OPEN condition. FIG. 9C illustrates the condition wherein the operating handle 122 is in the second switch operating slot 202, the operating handle 122, engaged handle operating yoke 142 and connected second switch operating mechanism 42 (not shown) have been rotated about the pivot shaft 170 such that the second switch 38 (not shown) is now in an ON or CLOSED condition and the first switch 30 (not shown) remains in the OFF or OPEN condition. Operation of the first switch 30 is accomplished in the same manner by sliding the operating handle 122 to the first end 210 of the neutral slot 206 and rotating into the first switch operating slot 198.

We claim:

1. An enclosure for a double pole switch, said enclosure comprising:

a bottom defining two generally parallel sides, two open ends and a back intermediate said generally parallel sides and said two open ends;

a pair of end walls for closing said open ends;

an operating handle configured for selectively engaging only one of two switch operating mechanisms at a time;

an operating handle support having a generally U-shaped cross-section and being positioned intermediate said generally parallel sides; and, a cover.

2. The enclosure of claim 1, wherein the position of said operating handle support defines two distinct switch compartments within the enclosure.

3. The enclosure of claim 2, wherein said operating handle support is positioned such that at least one conductor passage is defined between said two distinct switch compartments.

4. The enclosure of claim 1, wherein said operating handle support is attached to said two generally parallel sides.

5. The enclosure of claim 1, wherein said operating handle support is attached to said back.

6. The enclosure of claim 1, wherein said cover defines an access opening which provides access to said operating handle.

7. The enclosure of claim 6, wherein said operating handle support includes a perimetal flange for receiving a sealing means for effecting a seal between said operating handle support and said cover around said access opening.

8. An enclosure configured for a double pole switch, said enclosure comprising:

a bottom defining two generally parallel sides, two open ends and a back intermediate said generally parallel sides and said two open ends;

a pair of end walls for closing said open ends;

an operating handle support having a generally U-shaped cross-section and being positioned intermediate said generally parallel sides and said end walls such as to form two distinct switch compartments and at least one conductor passage connecting said switch compartments;

an operating handle configured to be snugly received within said generally U-shaped cross-section of said operating handle support; and, a cover.

9. The enclosure of claim 8, wherein said operating handle is configured for selectively operating two electrical switches such that only one of the two switches can be in an ON state at any particular time and both switches can be in an OFF state at the same time.

10. The enclosure of claim 8, wherein said operating handle support is attached to said two generally parallel sides of said bottom.

11. The enclosure of claim 8, wherein said conductor passage is defined generally between said operating handle support and said back of said bottom.

12. The enclosure of claim 8, wherein said operating handle support assembly is attached to said back of said bottom.

13. The enclosure of claim 8, wherein said conductor passage is defined generally between said operating handle support and said two parallel sides of said bottom.

14. An operating handle apparatus for a double throw switch comprising:

an operating handle having an operator end and a switch end, said switch end defining a pivot aperture;

a pivot shaft being slidably received in said pivot aperture;

a first handle engaging yoke;

a second handle engaging yoke; and an enclosure for enclosing said switch end of said operating handle, said pivot shaft and said first and second handle engaging yokes.

15. The operating handle apparatus of claim 14, wherein said first handle engaging yoke is adapted for operably connecting to a first switch operating mechanism and said second handle engaging yoke is adapted for operably connecting to a second switch operating mechanism.

16. The operating handle apparatus of claim 14, wherein said first and second handle engaging yokes are configured for operable engagement with said switch end of said handle.

17. The operating handle apparatus of claim 16, wherein said switch end of said handle selectively engages only one of said first or second handle engaging yokes at a time.

18. The operating handle apparatus of claim 14, wherein said pivot shaft provides pivotal and slidable support for said operating handle.

19. The operating handle apparatus of claim 14, wherein said operating handle is operably engaged with said first handle engaging yoke when in said first switch operating slot, is operably engaged to said second handle engaging yoke when in said second switch operating slot and can engage either or neither of said first or second handle engaging yokes when in said neutral slot.

* * * * *